United States Patent [19]

Johnson et al.

[11] 4,032,283

[45] June 28, 1977

[54] EXTERIOR CORNER TOOL

[75] Inventors: Eugene R. Johnson, Burlingame; Morris F. Mower, Santa Clara, both of Calif.

[73] Assignee: Bliss & Laughlin Ind., Inc., Oak Brook, Ill.

[22] Filed: Mar. 8, 1976

[21] Appl. No.: 664,583

[52] U.S. Cl. ..... 425/458; 15/235.7; 118/411

[51] Int. Cl.[2] ..... B05C 17/10

[58] Field of Search ..... 401/9, 261, 267; 425/458, 87, 218, 376; 15/105.5, 235.3, 235.4, 235.5, 235.6, 235.7, 235.8; 264/35

[56] References Cited

UNITED STATES PATENTS

| | | | |
|---|---|---|---|
| 2,594,606 | 4/1952 | Ames | 425/87 |
| 3,056,159 | 10/1962 | Hoveland | 15/235.7 |
| 3,241,174 | 3/1966 | Callahan | 15/235.6 X |

*Primary Examiner*—Robert L. Spicer, Jr.
*Assistant Examiner*—John S. Brown

[57] ABSTRACT

A corner tool for applying mastic material to an external corner formed by two walls which come together at approximately 90°, said tool comprising a retainer for mastic material that defines a cavity open in two convergent and substantially perpendicular planes, including a pair of slotted screed plates that extend substantially perpendicular to each other and transverse relative to the external corner, and means for positioning the mastic retainer relative to the external corner to maintain the slotted plates in contact with the two walls forming the corner while positioning the cavity in open-spaced relationship to the walls.

6 Claims, 6 Drawing Figures

EXTERIOR CORNER TOOL

This application relates to corner tools for applying mastic material along a wall joint and more particularly an external corner formed by two walls which come together at substantially right angles. Such a tool is particularly useful in covering an external corner with mastic material to which there is then applied a preformed corner strip.

One object of the present invention is to provide a corner tool of the kind described capable of applying a substantially uniform coating of plastic material to both side surfaces of an exterior wall joint.

Another object of the invention is to provide a corner tool of the kind described that is adaptable and conformable to exterior corner surfaces formed with slightly different angles of convergency.

A still further object of the invention is to provide a corner tool of the kind described that is easy to operate and which may be moved across a tape joint without injury to the joint or impairment to the application of mastic material from the corner tool.

Other objects and advantages of this invention will become apparent in view of the following detailed description.

In the drawings, forming a part of this application and in which like parts are identified by like reference numerals throughout the same:

Figure 1:
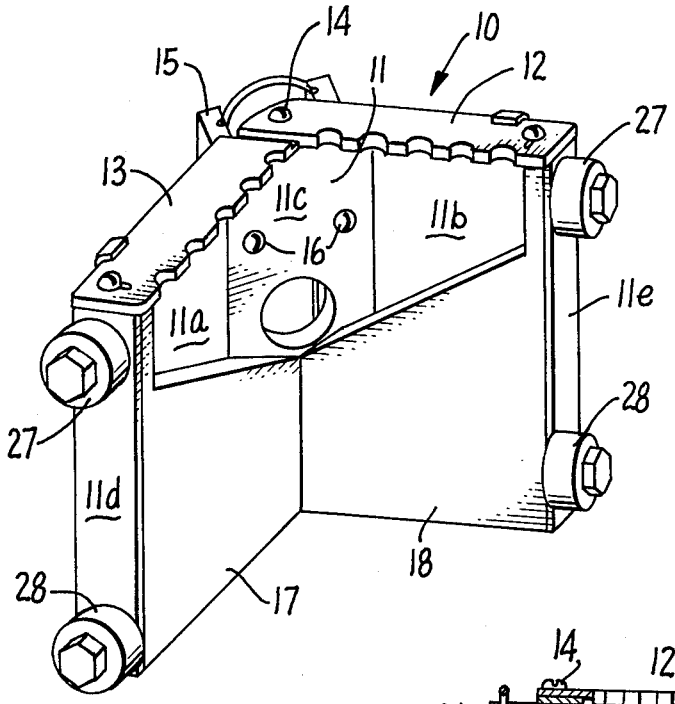
FIG. 1 is a perspective view of a preferred embodiment of the invention in a corner tool for applying mastic material.

Referring to FIG. 1 in particular, tool 10 comprises an angular plate 11 having a pair of convergent planar sides 11*a* and 11*b*, an integral center panel 11*c* and a pair of end flanges 11*d* and 11*e*. A pair of slotted screed plates 12 and 13 are pivotally connected by a pivot screw 14 to a mounting bracket 15, said bracket being attached to the backside of center panel 11*c* by means of screws 16. Mounting bracket 15 and center panel 11*c* are formed with concentric openings for introducing mastic material into a cavity that is defined, in part, by the sides 11*a* and 11*b*, center panel 11*c* and slotted screed plates 12 and 13. The inclined end surfaces of a pair of filler plates 17 and 18 further define this cavity.

Figure 3:
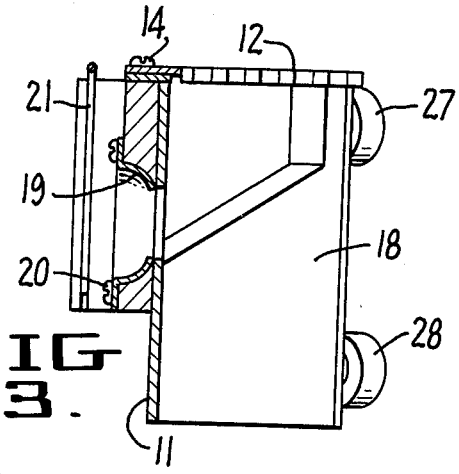
FIG. 3 is a vertical section taken on lines 3—3 of FIG. 2.

Referring to FIG. 3, mounting block 15 is formed with a spherical recess which accommodates or receives a liner 19, said liner being held to the block by a pair of screws 20. A spring clip 21, disposed in a pair of recesses formed in the mounting block, provide means for securing tool 10 to a mastic reservoir and dispenser. This detail of construction, or mounting device, has been used in connection with other types of mastic applicators and, therefore, is not a novel feature of the present invention.

Figure 2:
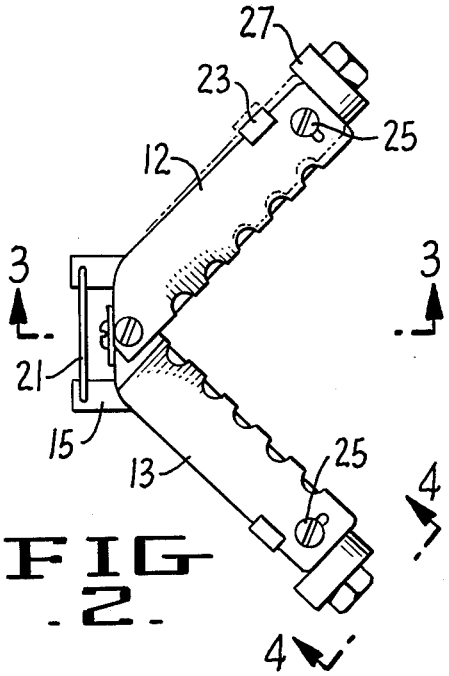
FIG. 2 is a top plan view of the finishing tool.

The pivotally joined ends of slotted screed plates 12 and 13 are formed with a half plate thickness, best shown in FIG. 3; and the ends are overlapped, allowing the slotted portions of the plates to be positioned in essentially the same plane. Each screed plate is contacted by a leaf spring 23 mounted to retainer plate 11 by a screw 24. Each leaf spring applies a spring bias urging its contacted screed plate to a position of convergency as shown in FIG. 2, the included angle between the slotted edges of the screed plates being slightly less than 90°. This position is established by contact with a pair of screw stops 25 mounted in the upright ends of filler plates 17 and 18, respectively. Each screw stop 25 extends through a slot formed in the screed plates.

It will be apparent that although the screed plates are biased to their set positions by springs 23, each screed plate may be pivoted and positioned relative to the other screed plate at a greater included angle in the event that the wall corner to which mastic material is to be applied is of an angle equal to or slightly greater than 90°. The resiliency of springs 23 accommodate this movement, as shown by the broken line position of screed plate 12 in FIG. 2.

Figure 4:
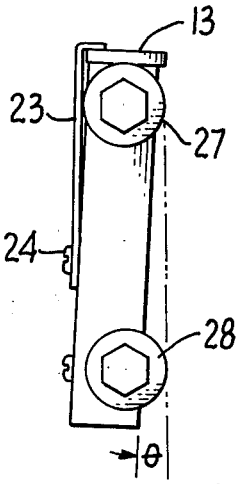
FIG. 4 is an end view taken on lines 4—4 of FIG. 2.
Figure 5:
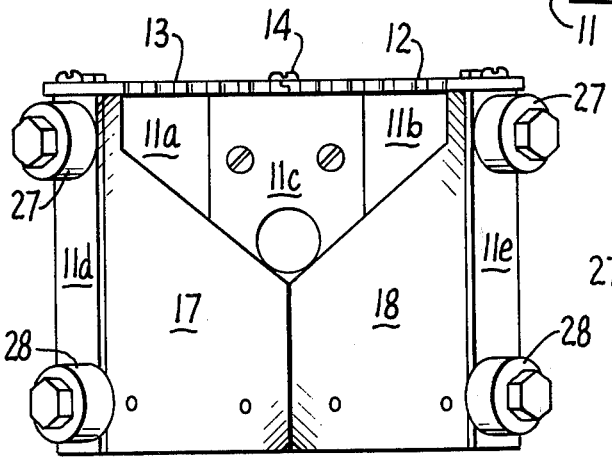
FIG. 5 is a corner elevation of the tool.
Figure 6:
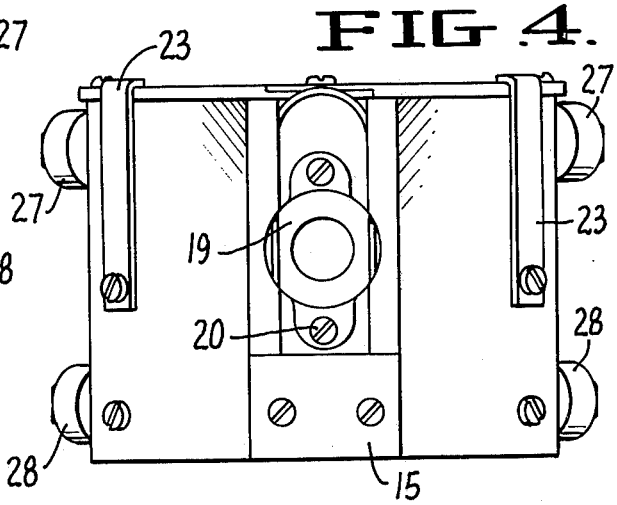
FIG. 6 is a rear elevation of the tool.

Corner tool 10 further comprises two pairs of rollers 27 and 28, one pair of rollers being rotatably mounted to end flange 11*d* and the other pair being mounted to end flange 11*e*. Referring to FIG. 4, it will be noted that the lower rolls 28 are laterally offset to position the surfaces of filler plates 17 and 18 at an angle $\theta$. The angle $\theta$, it has been found, may be varied between 2° and 10°. A failure to provide at least a 2° offset (or incline) is apt to cause interference or contact with a preformed tape joint, resulting in a defective use of tool 10 and possible disruption of a previously formed tape joint. In the event that the incline is greater than 10°, the mastic material will have a tendency to spread forward rather than through the slotted screed plates 12 and 13. Thus the filler plates 17 and 18 would lose their function, which is to define part of the mastic cavity and provide an extended surface or seal between the mastic cavity and the lead end of the tool.

Although a preferred embodiment of the invention has been illustrated and described, various modifications and changes may be resorted to without departing from the spirit of the invention or the scope of the appended claims, and each of such modifications and changes is contemplated.

What is claimed is:

1. A corner tool for applying mastic material to an external corner formed by two surfaces which come together at approximately 90°, said tool comprising:

container means defining a cavity that is open in two convergent and substantially perpendicular planes and having surfaces in each of said planes that converge peripherally of said cavity and come together at an internal corner, said container means including a pair of slotted screed plates that extend substantially perpendicular to each other and transverse relative to said corner; and means for positioning said container means relative to an external corner of approximately 90° to maintain said slotted plates in contact with two surfaces forming the external corner while positioning the cavity of said tool in open-spaced relationship to the surface; whereby mastic material introduced into said cavity may be applied simultaneously to the surfaces on either side of the external corner through said slotted screed plates.

2. The corner tool of claim 1 and further wherein said means for positioning said container means comprises two pairs of rollers mounted thereon, one set of rollers being positioned for engaging one surface, and the other pair, a second surface, of two walls forming an external corner of approximately 90°.

3. The corner tool of claim 2, each pair of rollers being mounted to said container means for positioning the opening of the cavity at an inclined angle relative to the walls on either side of the external corner, the opening of said cavity being supported at an angle relative to each wall that is greater than 2° and less than 10°.

4. The corner tool of claim 1 and further including means for biasing said pair of slotted screed plates to form wall contacting surfaces, the included angle between said surfaces being less than 90°.

5. The corner tool of claim 1, said container means comprising an angular support plate having a pair of side panels interonnected at an angle of approximately 90°; and a pair of filler plates secured to said sides, respectively, the end of each filler plate defining a portion of the tool cavity.

6. The corner tool of claim 1 and further comprising means for connecting said tool to a mastic dispenser and introducing mastic material directly into said cavity.

* * * * *